US009792754B2

(12) United States Patent
Nakashima et al.

(10) Patent No.: US 9,792,754 B2
(45) Date of Patent: Oct. 17, 2017

(54) BANKNOTE HANDLING APPARATUS

(75) Inventors: Yoshiomi Nakashima, Tokyo-To (JP); Kozen Nakai, Funabashi (JP); Toshihide Asada, Himeji (JP)

(73) Assignee: GLORY LTD., Himeji-shi, Hyogo-ken (JP)

( * ) Notice: Subject to any disclaimer, the term of this patent is extended or adjusted under 35 U.S.C. 154(b) by 23 days.

(21) Appl. No.: 14/407,188

(22) PCT Filed: Jun. 13, 2012

(86) PCT No.: PCT/JP2012/065093
§ 371 (c)(1),
(2), (4) Date: Mar. 25, 2015

(87) PCT Pub. No.: WO2013/186865
PCT Pub. Date: Dec. 19, 2013

(65) Prior Publication Data

US 2015/0221158 A1 Aug. 6, 2015

(51) Int. Cl.
*G07F 7/04* (2006.01)
*G07D 11/00* (2006.01)

(52) U.S. Cl.
CPC ..... *G07D 11/0084* (2013.01); *G07D 11/006* (2013.01); *G07D 11/0054* (2013.01)

(58) Field of Classification Search
CPC ..... G07D 11/0051; G07D 11/0054; G07D 11/0057; G07D 11/006; G07D 11/0063;
(Continued)

(56) References Cited

U.S. PATENT DOCUMENTS 5,815,592 A * 9/1998 Mennie ..... B65H 3/063 209/534
6,278,795 B1 * 8/2001 Anderson ..... G07D 7/00 194/206

(Continued)

FOREIGN PATENT DOCUMENTS

CN 101601075 A 12/2009
CN 101952858 A 1/2011

(Continued)

OTHER PUBLICATIONS

European Search Report (Application No. 128791258—PCT/JP2012/065093) (7 pages—dated May 1, 2016).

(Continued)

*Primary Examiner* — Jeffrey Shapiro
(74) *Attorney, Agent, or Firm* — Renner, Kenner, Greive, Bobak, Taylor & Weber

(57) ABSTRACT

A banknote handling apparatus 100 is configured to perform a sorting process of banknotes. The banknote handling apparatus includes: a taking-in unit 10 configured to take in a banknote one by one; a transport unit 70 configured to transport the banknote having been taken in from the taking-in unit 10; a recognition unit 20 configured to recognize the banknote transported by the transport unit 70; a control unit 50 configured to control the transport unit 70, such that the banknote having been recognized by the recognition unit 20 is transported to any one of a plurality of stacking units 60*a* to 60*h*, based on a sorting pattern; and a sorting-category receiving unit 40 configured to receive at least one sorting category. The control unit 50 is configured to create the sorting pattern by deciding types of banknotes to be stacked in the respective stacking units 60*a* to 60*h*, based on the number of the stacking units 60*a* to 60*h* and the sorting category.

8 Claims, 7 Drawing Sheets

(58) Field of Classification Search
CPC ..... G07D 11/0066; G07D 11/0084; G07D 11/0006; G07D 11/0009; G07D 11/0012; G07D 11/0015
USPC ..... 194/206, 207; 209/534; 235/379
See application file for complete search history.

(56) References Cited

U.S. PATENT DOCUMENTS

| | | | | |
|---|---|---|---|---|
| 8,220,638 | B2 * | 7/2012 | Kuroda | G07D 11/00 194/206 |
| 2003/0000871 | A1 * | 1/2003 | Fitzgibbons | B07C 3/00 209/534 |
| 2004/0093117 | A1 * | 5/2004 | Daout | G07D 11/0006 700/231 |
| 2005/0207634 | A1 | 9/2005 | Jones et al. | |
| 2006/0076212 | A1 * | 4/2006 | Kuroda | G07D 11/00 194/206 |
| 2008/0060906 | A1 * | 3/2008 | Fitzgerald | G07D 11/0081 194/207 |
| 2010/0017018 | A1 * | 1/2010 | Morino | G07D 7/18 700/223 |
| 2011/0019899 | A1 | 1/2011 | Matsuura et al. | |
| 2011/0125313 | A1 * | 5/2011 | Hodatsu | G07D 11/0084 700/223 |
| 2011/0172808 | A1 * | 7/2011 | Fu | G07D 11/0066 700/215 |
| 2012/0125734 | A1 * | 5/2012 | Okamura | G07D 11/006 194/216 |

FOREIGN PATENT DOCUMENTS

| | | | |
|---|---|---|---|
| CN | 102160096 | A | 8/2011 |
| CN | 202205256 | U | 4/2012 |
| EP | 2 110 789 | A1 | 10/2009 |
| EP | 2 112 633 | A1 | 10/2009 |
| EP | 2 184 718 | A1 | 5/2010 |
| RU | 2 372 661 | C2 | 11/2009 |
| WO | WO 2008/096429 | A1 | 8/2008 |
| WO | WO 2009/110079 | A1 | 9/2009 |
| WO | WO 2009/122504 | A1 | 10/2009 |
| WO | WO 2011/009856 | A1 | 1/2011 |

OTHER PUBLICATIONS

Russian Office Action with English translation (Application No. 201500527/08(000809)) (8 pages—dated Mar. 2, 2016).
Chinese Office Action with English translation (Application No. 201280074687.2) (13 pages—dated Apr. 6, 2016).
Russian Office Action with English translation (Application No. 2015100527/08(000809)) (8 pages—dated Mar. 2, 2016).

* cited by examiner

| STACKING UNIT | DENOMI-NATION | ORIENTATION | FITNESS | VERSION |
|---|---|---|---|---|
| 1 | AUTOMATIC | MIXED | MIXED | NEW BANKNOTE |
| 2 | AUTOMATIC | MIXED | MIXED | OLD BANKNOTE |
| 3 | AUTOMATIC | MIXED | MIXED | NEW BANKNOTE |
| 4 | AUTOMATIC | MIXED | MIXED | OLD BANKNOTE |
| 5 | AUTOMATIC | MIXED | MIXED | NEW BANKNOTE |
| 6 | AUTOMATIC | MIXED | MIXED | OLD BANKNOTE |
| 7 | AUTOMATIC | MIXED | MIXED | NEW BANKNOTE |
| 8 | AUTOMATIC | MIXED | MIXED | OLD BANKNOTE |

| STACKING UNIT | DENOMI-NATION | ORIENTATION | FITNESS | VERSION |
|---|---|---|---|---|
| 1 | FIRST BANKNOTE | A | MIXED | MIXED |
| 2 | FIRST BANKNOTE | B | MIXED | MIXED |
| 3 | FIRST BANKNOTE | C | MIXED | MIXED |
| 4 | FIRST BANKNOTE | D | MIXED | MIXED |
| 5 | SECOND BANKNOTE | A | MIXED | MIXED |
| 6 | SECOND BANKNOTE | B | MIXED | MIXED |
| 7 | SECOND BANKNOTE | C | MIXED | MIXED |
| 8 | SECOND BANKNOTE | D | MIXED | MIXED |

F I G. 5

| STACKING UNIT | DENOMI-NATION | ORIENTATION | FITNESS | VERSION |
|---|---|---|---|---|
| 1 | 10000 | MIXED | MIXED | MIXED |
| 2 | 5000 | MIXED | MIXED | MIXED |
| 3 | 2000 | MIXED | MIXED | MIXED |
| 4 | 1000 | MIXED | MIXED | MIXED |
| 5 | – | – | – | – |
| 6 | – | – | – | – |
| 7 | – | – | – | – |
| 8 | – | – | – | – |

FIG. 6(a)

| STACKING UNIT | DENOMI-NATION | ORIENTATION | FITNESS | VERSION |
|---|---|---|---|---|
| 1 | 10000 | MIXED | ATM | FIRST BANKNOTE |
| 2 | 10000 | MIXED | TLR | FIRST BANKNOTE |
| 3 | 10000 | MIXED | UNFIT | FIRST BANKNOTE |
| 4 | 10000 | MIXED | ATM | SECOND BANKNOTE |
| 5 | 10000 | MIXED | TLR | SECOND BANKNOTE |
| 6 | 10000 | MIXED | UNFIT | SECOND BANKNOTE |
| 7 | – | – | – | – |
| 8 | – | – | – | – |

FIG. 6(b)

| STACKING UNIT | DENOMI-NATION | ORIENTATION | FITNESS | VERSION |
|---|---|---|---|---|
| 1 | 10000 | A | MIXED | MIXED |
| 2 | 10000 | B | MIXED | MIXED |
| 3 | 10000 | C | MIXED | MIXED |
| 4 | 10000 | D | MIXED | MIXED |
| 5 | 1000 | A | MIXED | MIXED |
| 6 | 1000 | B | MIXED | MIXED |
| 7 | 1000 | C | MIXED | MIXED |
| 8 | 1000 | D | MIXED | MIXED |

FIG. 7(a)

| STACKING UNIT | DENOMI-NATION | ORIENTATION | FITNESS | VERSION |
|---|---|---|---|---|
| 1 | FIRST BANKNOTE | A | MIXED | MIXED |
| 2 | FIRST BANKNOTE | B | MIXED | MIXED |
| 3 | FIRST BANKNOTE | C | MIXED | MIXED |
| 4 | FIRST BANKNOTE | D | MIXED | MIXED |
| 5 | SECOND BANKNOTE | A | MIXED | MIXED |
| 6 | SECOND BANKNOTE | B | MIXED | MIXED |
| 7 | SECOND BANKNOTE | C | MIXED | MIXED |
| 8 | SECOND BANKNOTE | D | MIXED | MIXED |

FIG. 7(b)

| STACKING UNIT | DENOMI-NATION | ORIENTATION | FITNESS | VERSION |
|---|---|---|---|---|
| 1 | 5000 | A | MIXED | MIXED |
| 2 | 5000 | B | MIXED | MIXED |
| 3 | 5000 | C | MIXED | MIXED |
| 4 | 5000 | D | MIXED | MIXED |
| 5 | 2000 | A | MIXED | MIXED |
| 6 | 2000 | B | MIXED | MIXED |
| 7 | 2000 | C | MIXED | MIXED |
| 8 | 2000 | D | MIXED | MIXED |

FIG. 7(c)

BANKNOTE HANDLING APPARATUS

TECHNICAL FIELD

The present invention relates to a banknote handling apparatus configured to perform a banknote sorting process.

BACKGROUND ART

There has been conventionally known a banknote handling apparatus configured to perform a banknote sorting process, the banknote handling apparatus including: a taking-in unit configured to take in a banknote one by one; a transport unit configured to transport the banknote having been taken in from the taking-in unit; a recognition sensor configured to obtain information for recognizing the banknote transported by the transport unit; a control unit configured to recognize the banknote based on the information obtained by the recognition sensor; and a plurality of stacking units configured to stack the banknote based on a recognition result by the control unit.

As such a banknote handling apparatus, there is known an apparatus in which a user can freely decide a sorting condition for each sorting category, such as a denomination of a banknote stacked in each stacking unit, a version of the banknote (version type), an orientation of the banknote, a fitness of the banknote and so on, so as to set a sorting pattern of the stacking units as a whole (see, e.g., WO2008/096429).

DISCLOSURE OF THE INVENTION

However, in the banknote handling apparatus disclosed in WO2008/096429, a degree of freedom of setting is high, while a setting operation is complicated. In addition, when banknotes are sorted with a predetermined purpose, it is necessary for a user to have a full knowledge about the sorting condition for each sorting category set for each stacking unit. Thus, it is very difficult to create a sorting pattern and to sort banknotes, just as a purpose desired by the user.

In view of the above circumstances, the present invention provides a banknote handling apparatus capable of easily sorting banknotes according to a purpose desired by a user.

A banknote handling apparatus according to the present invention is a banknote handling apparatus configured to perform a sorting process of banknotes, the banknote handling apparatus comprising:

a taking-in unit configured to take in a banknote one by one;

a transport unit configured to transport the banknote having been taken in from the taking-in unit;

a recognition unit configured to recognize the banknote transported by the transport unit;

a control unit configured to control the transport unit, such that the banknote having been recognized by the recognition unit is transported to any one of a plurality of stacking units, based on a sorting pattern; and a sorting-category receiving unit configured to receive at least one sorting category;

wherein the control unit is configured to create the sorting pattern, based on the number of stacking units and the sorting category received by the sorting-category receiving unit.

In the banknote handling apparatus according to the present invention, the control unit may be configured to create a plurality of the sorting patterns.

In the banknote handling apparatus according to the present invention, the control unit may be configured to decide whether plural times of the sorting processes are required or not, in order to sort banknotes based on the sorting category received by the sorting-category receiving unit, and when the control unit decides that the plural times of the sorting processes are required, the control unit may create at least two sorting patterns different from one another.

In the banknote handling apparatus according to the present invention, the control unit may be configured to decide whether plural times of the sorting processes are required or not, in order to sort banknotes based on the sorting category received by the sorting-category receiving unit, and when the control unit decides that the plural times of the sorting processes are required, the control unit may sort the banknotes by using a duplicated sorting pattern at least once and may stack the banknotes in the stacking units.

In the banknote handling apparatus according to the present invention, the control unit may be configured to decide whether three or more times of the sorting processes are required or not, in order to sort banknotes based on the sorting category received by the sorting-category receiving unit, and when the control unit decides that three or more times of the sorting processes are required, the control unit may create at least two sorting patterns different from one another, may sort the banknotes by using each sorting pattern and may stack the banknotes in the stacking units, and the control unit may sort the banknotes by using a duplicated sorting pattern at least once and may stack the banknotes in the stacking units.

In the banknote handling apparatus according to the present invention, the control unit may be configured to decide whether plural times of the sorting processes are required or not, in order to sort banknotes based on the sorting category received by the sorting-category receiving unit, and when the control unit decides that the plural times of the sorting processes are required, the control unit may automatically decide sorting patterns to be used and a using order of the sorting patterns.

In the banknote handling apparatus according to the present invention, after finishing the sorting process of n-th time, the control unit may be automatically set to sort banknotes based on a sorting pattern to be used in the sorting process of (n+1)-th time.

In the banknote handling apparatus according to the present invention, the control unit may be configured to output information related to an operation to be next required or related to the sorting process to be next performed.

In the banknote handling apparatus according to the present invention, the sorting category may include a denomination of the banknote, and the control unit may be configured to create the sorting pattern by deciding contents of banknotes to be stacked in each stacking unit, based on the number of the stacking units and at least the denomination of the banknote.

In the banknote handling apparatus according to the present invention, the sorting category may include at least one of a currency type, an orientation of the banknote, a fitness of the banknote and a version of the banknote, and the control unit may be configured to create the sorting pattern by deciding contents of banknotes to be stacked in each stacking unit, based on the number of the stacking units, and at least one of the currency type, the orientation of the banknote, the fitness of the banknote and the version of the banknote.

In the banknote handling apparatus according to the present invention, the sorting pattern may be created by selecting a predetermined sorting mode out of a plurality of sorting modes, for each stacking unit and for each sorting category.

In the present invention, there is provided the sorting-category receiving unit that receives at least one sorting category to be recognized by the control unit, and the control unit is configured to create a sorting pattern by deciding types of banknotes to be stacked in the respective stacking units, based on the number of the stacking units and the sorting category received by the sorting-category receiving unit. Thus, banknotes can be easily sorted according to a purposed desired by a user, without excessive burden on the user.

BRIEF DESCRIPTION OF THE DRAWINGS

FIG. 5 is a table showing another example of a sorting pattern created by the banknote handling apparatus according to the embodiment of the present invention.

FIG. 6 is a table showing a sorting pattern used in Example 1 of the present invention.

FIG. 7 is a table showing a sorting pattern used in Example 2 of the present invention.

BEST MODE FOR CARRYING OUT THE INVENTION

Embodiment

<<Structure>>

An embodiment of a banknote handling apparatus according to the present invention will be described herebelow with reference to the drawings. FIGS. 1 to 7 are views showing the embodiment of the present invention.

Figure 1:
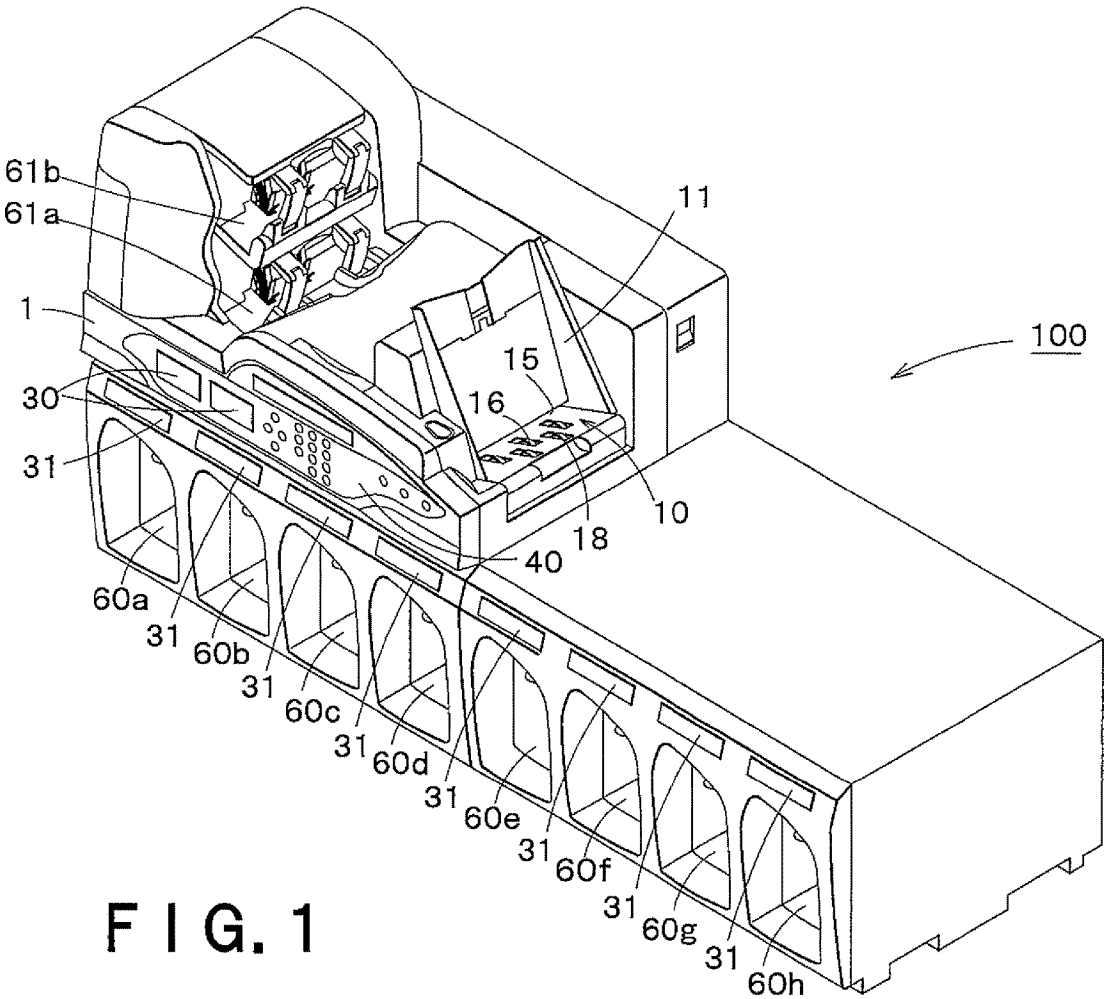
FIG. 1 is a perspective view of a banknote handling apparatus according to an embodiment of the present invention.

A banknote handling apparatus 100 in this embodiment is configured to perform a banknote sorting process. As shown in FIG. 1, the banknote handling apparatus 100 includes a housing 1, a placing unit 11 on which a banknote can be placed, and a taking-in unit 10 configured to take a banknote, one by one, from an inlet opening 15 into the housing 1.

Figure 2:
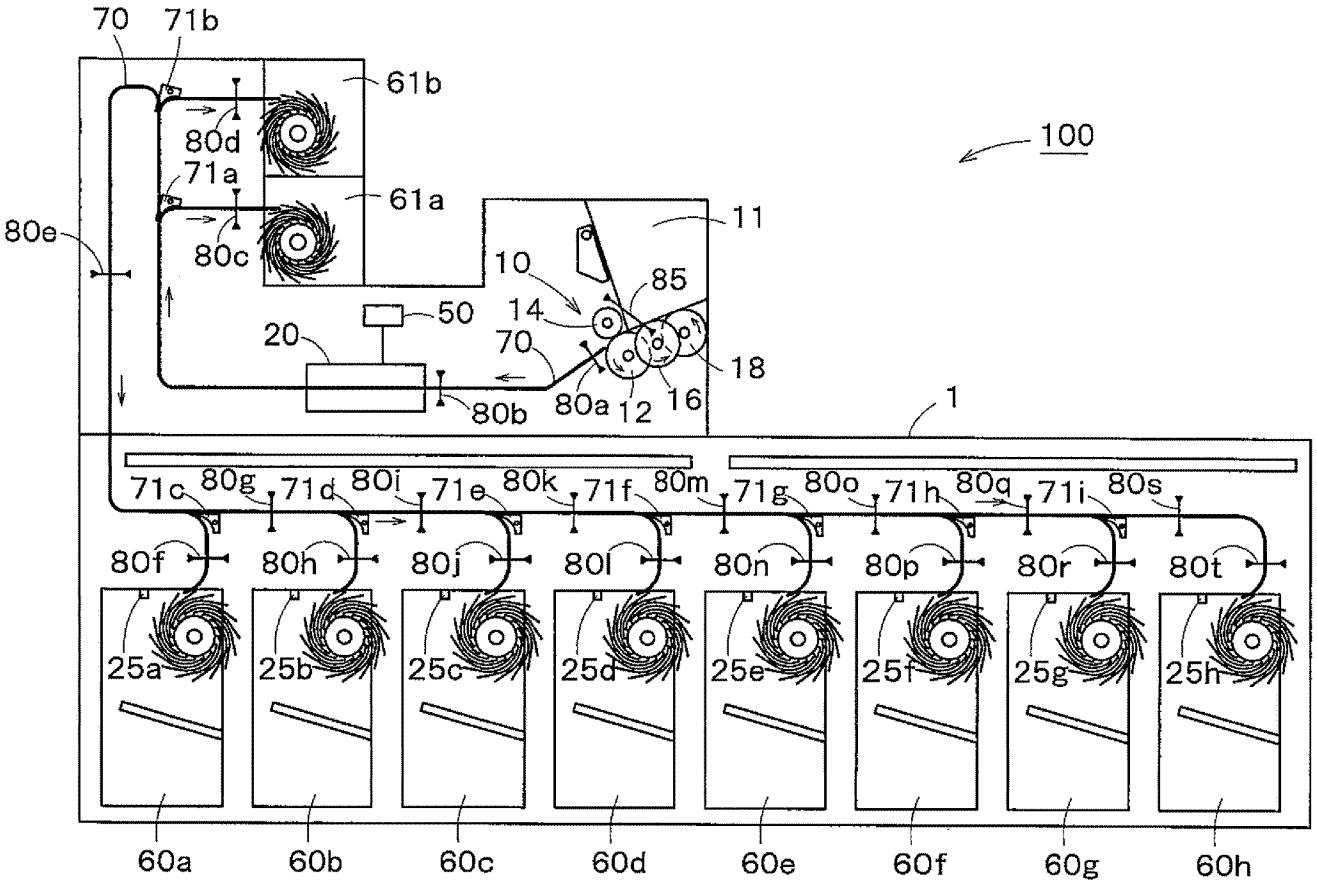
FIG. 2 is a longitudinal sectional view schematically showing an inside structure of the banknote handling apparatus according to the embodiment of the present invention.

In addition, as shown in FIG. 2, the banknote handling apparatus 100 also includes: a transport unit 70 configured to transport a banknote having been taken in from the taking-in unit 10; a recognition unit 20 configured to recognize a banknote by obtaining information for recognizing a banknote transported by the transport unit 70; a plurality of stacking units 60*a* to 60*h* configured to stack a banknote; reject units 61*a* and 61*b* configured to reject a banknote that is not stacked in any of the stacking units 60*a* to 60*h*; and a control unit 50 configured to control the transport unit 70 such that a taken-in banknote is transported to any of the plurality of stacking units 60*a* to 60*h* or the reject units 61*a* and 61*b*, based on a recognition result of the recognition unit 20.

In this embodiment, the stacking units 60*a* to 60*h* include a first stacking unit 60*a*, a second stacking unit 60*b* disposed adjacently to the first stacking unit 60*a*, a third stacking unit 60*c* disposed adjacently to the second stacking unit 60*b*, a fourth stacking unit 60*d* disposed adjacently to the third stacking unit 60*c*, a fourth stacking unit 60*d* disposed adjacently to the third stacking unit 60*c*, a fifth stacking unit 60*e* disposed adjacently to the fourth stacking unit 60*d*, a sixth stacking unit 60*f* disposed adjacently to the fifth stacking unit 60*e*, a seventh stacking unit 60*g* disposed adjacently to the sixth stacking unit 60*f*, and an eighth stacking unit 60*h* disposed adjacently to the seventh stacking unit 60*g*. Namely, the present invention is explained using a case in which the eight stacking units are provided. However, it goes without saying that the number of stacking units 60*a* to 60*h* is not limited thereto. In addition, although FIG. 1 shows a case in which a front surface of each of the stacking units 60*a* to 60*h* is opened, the present invention is not limited thereto. A case in which a front surface of the housing 1 is not opened so that an inside of each of the stacking units 60*a* to 60*h* cannot be seen from outside, and a case in which an openable and closable door for covering an opening is provided on a front surface of each of the stacking units 60*a* to 60*h*, are possible.

Each of the stacking units 60*a* to 60*h* can stack five hundreds banknotes, for example. In this embodiment, a surface in which each of the stacking units 60*a* to 60*h* is opened is referred to as "front surface" and a surface reverse thereto is referred to as "rear surface".

As shown in FIG. 2, the aforementioned taking-in unit 10 includes kicker rollers 16 and 18 provided on the placing unit 11 for giving a driving force to a lowermost banknote, and gate mechanisms 12 and 14 configured to sandwich therebetween a banknote, to which a driving force has been given by the kicker rollers 16 and 18, to feed the banknote into the housing 11. The gate mechanisms 12 and 14 include a feed roller 12 and a gate roller 14 that are provided opposedly to the feed roller 12.

The placing unit 11 is equipped with an existence sensor 85 configured to detect whether a banknote is placed. The transport unit 70 is equipped with a plurality of passage sensors 80*a* to 80*t* configured to detect that a banknote has passed. The stacking units 60*a* to 60*h* are respectively equipped with remaining sensors 25*a* to 25*h* configured to detect a banknote stacking condition.

In addition, the transport unit 70 is equipped with a plurality of diverter members 71*a* to 71*i* configured to suitably diverge a banknote transported by the transport unit 70.

The banknote handling apparatus 100 also includes a sorting-category receiving unit 40 configured to receive at least one sorting category to be recognized by the control unit 50. In this embodiment, an operation unit 40 (see FIG. 1) provided on the housing 1 serves as the sorting-category receiving unit 40.

The housing 1 is provided with a main display unit 30 that is an LCD (liquid Crystal Display) configured to display information outputted from the control unit 50, and an individual display unit 31 that is an LED (Light Emitting Diode) configured to display information outputted from the control unit 50. The main display unit 30 includes two display screens. The individual display unit 31 is disposed at a position correspondingly to each of the stacking units 60*a* to 60*h*.

The control unit 50 in this embodiment is configured to create a sorting pattern by deciding types of banknotes to be stacked in the respective stacking units 60*a* to 60*h*, based on the number of the stacking units 60*a* to 60*h* ("eight" in this embodiment) and a sorting category received by the operation unit 40. The sorting pattern created by the control unit 50 is stored in a memory unit 55 (see FIG. 3) connected to the control unit 50.

The control unit 50 in this embodiment can create a plurality of sorting patterns. The control unit 50 is configured to decide whether plural times of sorting processes are required or not, in order to sort banknotes based on a sorting category received by the operation unit 40. When the control unit 50 decides that the plural times of sorting processes are required, the control unit 50 creates two or more sorting patterns different from one another, so that banknotes can be sorted by using these sorting patterns and stacked in the stacking units 60*a* to 60*h*.

Even when the plural times of sorting processes are required, it is not always necessary to use two or more sorting patterns different from one another. The control unit 50 in this embodiment is configured to decide whether the plural times of sorting processes are required or not in order to sort banknotes based on a sorting category received by the operation unit 40, and even when the control unit 50 decides that the plural times of sorting processes are required, the banknotes can be sorted by using a duplicated sorting pattern and stacked in the stacking units 60*a* to 60*h*.

In addition, banknotes can be sorted by using both two or more sorting patterns different from one another and the duplicated sorting pattern and stacked in the stacking units 60*a* to 60*h*. Namely, the control unit 50 in this embodiment is configured to decide whether three or more times of sorting processes are required or not, in order to sort banknotes based on a sorting category received by the operation unit 40. When the control unit 50 decides that three or more times of sorting processes are required, the control unit 50 can create at least two sorting patterns different from each other, sort the banknotes by using each pattern and stack the banknotes in the stacking units 60*a* to 60*h*, and the control unit 50 can sort the banknotes by using a duplicated sorting pattern at least once and stack the banknotes in the stacking units 60*a* to 60*h*.

The case in which the plural times of sorting processes are required includes, for example, a case in which a "product" of the number of elements of the sorting category received by the operation unit 40 is greater than the number of the stacking units 60*a* to 60*h*, a case in which a banknote is transported to the reject unit 61*a* or 61*b*, and so on. The example is explained taking as a currency "yen" by way of example. The number of banknote denomination elements is four: 1,000 yen, 2,000 yen, 5,000 yen and 10,000 yen. The number of banknote fitness elements is three, which will be described later. The number of banknote version (version type) elements is two: new banknote and old banknote. The number of banknote orientation elements is four: A orientation (an orientation in which, when a banknote is placed on the placing unit 11, the front surface is oriented upward and an upper part of the portrait is oriented in the transport direction); B orientation (an orientation in which, when the banknote is placed on the placing unit 11, the front surface is oriented upward and a lower part of the portrait is oriented in the transport direction); C orientation (an orientation in which, when the banknote is placed on the placing unit 11, the front surface is oriented downward and the lower part of the portrait is oriented in the transport direction); and D orientation (an orientation in which, when the banknote is placed on the placing unit 11, the front surface is oriented downward and the upper part of the portrait is oriented in the transport direction).

The control unit 50 in this embodiment is configured to output information related to an operation to be next required and related to the sorting process to be next performed, and to cause the information to be displayed on the main display unit 30.

In this embodiment, although there is explained a case in which the main display unit 30 of the banknote handling apparatus 100 displays the information outputted from the control unit 50, the present invention is to limited thereto. An external apparatus, such as a personal computer, connected to the banknote handling apparatus 100 may display the information outputted from the control unit 50, and the main display unit 30 of the banknote handling apparatus 100 may not display the information outputted from the control unit 50.

The contents to be displayed on the main display unit 30 may include a message requesting a user to perform a predetermined operation such as "Select category for sorting.", a message showing the sorting process to be next performed and requesting a user to perform a predetermined operation such as "Sorting based on denomination and orientation is performed. Set banknotes in inlet opening." and "Sorting based on orientation is performed. Set banknotes in inlet opening.", for example.

The control unit 50 in this embodiment is configured to decide whether the plural times of sorting processes are required or not, in order to sort banknotes based on a sorting category received by the operation unit 40. When the control unit 50 decides that the plural times of sorting processes are required, the control unit 50 automatically decides, not only sorting patterns to be used, but also a using order of the sorting patterns to be used.

Further, after finishing the sorting process of n-th time, the control unit 50 in this embodiment is automatically set so as to sort banknotes based on a sorting pattern to be used in the sorting process of (n+1)-th time.

It goes without saying that to automatically decide a using order of the sorting patterns as described above is not necessary. The control unit 50 decides whether the plural times of sorting processes are required or not in order to sort banknotes based on a sorting category received by the operation unit 40, and when the control unit 50 decides that the plural times of sorting processes are required, a plurality of sorting patterns may be displayed on the main display unit 30, and an operator may select a desired sorting pattern through the operation unit 40.

In addition, it also goes without saying that to automatically set the control unit 50 to sort banknotes based on a next sorting pattern is not necessary. After finishing the sorting process of n-th times, the control unit 50 may cause the main display unit 30 to display a sorting pattern to be next performed, and a user may select a desired sorting pattern through the operation unit 40. When there are a plurality of sorting patterns to be next performed, the plurality of sorting patterns may be displayed on the main display unit 30, or only one recommended sorting pattern may be displayed on the main display unit 30.

The sorting category may include a denomination of the banknote. In this case, the control unit 50 creates a sorting pattern by deciding contents of banknotes to be stacked in the respective stacking units 60*a* to 60*h*, based on the number of stacking units 60*a* to 60*h* and the denomination of the banknote. If the recognition unit 20 can recognize currencies of a plurality of countries, a type of a currency to be sorted may be selected after selection of a denomination as the sorting category. Thus, denomination elements to be sorted may be limited to a denomination of the selected currency.

In addition, the sorting category may include at least one of a currency type, an orientation of the banknote, a fitness of the banknote and a version of the banknote. In this case, the control unit 50 creates a sorting pattern by deciding contents of banknotes to be stacked in the respective stacking units 60*a* to 60*h*, based on the number of the stacking units 60*a* to 60*h* and at least one of the currency type, the orientation of the banknote, the fitness of the banknote and the version of the banknote.

Figures 3, 4:
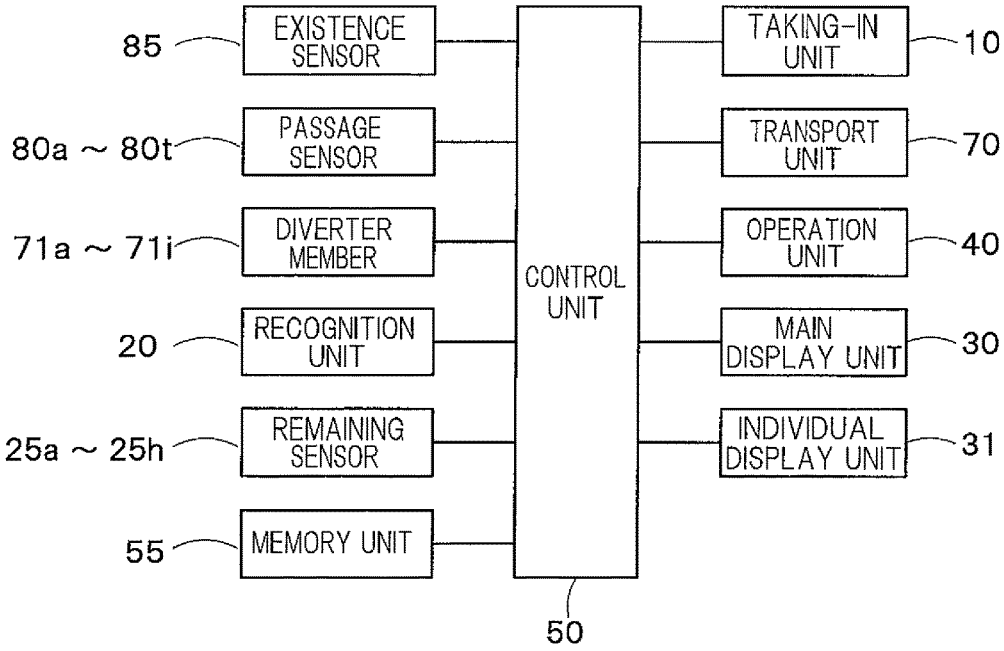
FIG. 3 is a control block diagram of the banknote handling apparatus according to the embodiment of the present invention.
FIG. 4 is a table showing an example of a sorting pattern created by the banknote handling apparatus according to the embodiment of the present invention.

A sorting pattern may be created, for example, by selecting a predetermined sorting mode out of a plurality of sorting modes, for each of the stacking units 60*a* to 60*h* and for each sorting category (see FIGS. 4 and 5). To be more specific, a predetermined sorting mode can be selected for the respective stacking units 60*a* to 60*h* as to the denomination of the banknote, the orientation of the banknote, the fitness of the banknote and the version of the banknote.

The sorting mode may include any of a "specified mode" in which a concrete element of each sorting category is specified, an "automatic mode" to be automatically decided (for example, automatically decided based on an order of recognition), and a "mixed mode" in which banknotes are stacked in a mixed manner.

In an example shown in FIG. 4, banknotes are stacked in the respective stacking units 60*a* to 60*h* in such a manner that the denomination of the banknote is under the "automatic mode", banknotes are stacked in the respective stacking units 60*a* to 60*h* in such a manner that the orientation of the banknote is under the "mixed mode", banknotes are stacked in the respective stacking units 60*a* to 60*h* in such a manner that the fitness of the banknote is under the "mixed mode". A banknote to be stacked in the first stacking units 60*a*, the third stacking unit 60*c*, the fifth stacking unit 60*e* and the seventh stacking unit 60*g* is a "new banknote", and a banknote to be stacked in the second stacking unit 60*b*, the fourth stacking unit 60*d*, the sixth stacking unit 60*f* and the eighth stacking unit 60*h* is an "old banknote".

In addition, in an example shown in FIG. 5, a denomination of banknotes to be stacked in the first stacking unit 60*a*, the second stacking unit 60*b*, the third stacking unit 60*c* and the fourth stacking unit 60*d* is a denomination of a banknote ("first banknote") that is firstly decided, a denomination of banknotes to be stacked in the fifth stacking unit 60*e*, the sixth stacking unit 60*f*, the seventh stacking unit 60*g* and the eighth stacking unit 60*h* is a denomination of a banknote (denomination of "second banknote") that is decided secondly or later and decided for the first time to be different from the denomination of the banknote that is firstly decided, an orientation of banknotes to be stacked in the first stacking unit 60*a* and the fifth stacking unit 60*e* is the "A orientation", an orientation of banknotes to be stacked in the second stacking unit 60*b* and the sixth stacking unit 60*f* is the "B orientation", an orientation of banknotes to be stacked in the third stacking unit 60*c* and the seventh stacking unit 60*g* is the "C orientation", and an orientation of banknotes to be stacked in the fourth stacking unit 60*d* and the eighth stacking unit 60*h* is the "D orientation". In addition, banknotes are stacked in the respective stacking units 60*a* to 60*h* in such a manner that the fitness of the banknote is under the "mixed mode", and banknotes are stacked in the respective stacking units 60*a* to 60*h* in such a manner that the version of the banknote is under the "mixed mode".

The aspect, in which a denomination of banknotes to be stacked in the first stacking unit 60*a*, the second stacking unit 60*b*, the third stacking unit 60*ca* and the fourth stacking unit 60*d* is a denomination of the "first banknote" and a denomination of banknotes to be stacked in the fifth stacking unit 60*e*, the sixth stacking unit 60*f*, the seventh stacking unit 60*g* and the eighth stacking unit 60*h* is a denomination of the "second banknote", is one type of the "automatic mode".

When banknotes are sorted by the fitness of the banknote, the banknotes are sorted into three groups: a banknote that can be used as a banknote to be dispensed from an ATM installed in a financial facility such as a bank; a banknote that cannot be used in an ATM but can be used as a banknote to be dispensed from a counter of a financial facility such as a bank; and a banknote that cannot be used as a banknote to be dispensed from an ATM and cannot be used as a banknote to be dispensed from a counter of a financial facility such as a bank.

As shown in FIG. 3, connected to the control unit 50 are the existence sensor 85, the passage sensors 80*a* to 80*t*, the diverter members 71*a* to 71*i*, the recognition unit 20, the remaining sensors 25*a* to 25*h*, the memory unit 55, the taking-in unit 10, the transport unit 70, the operation unit 40, the main display unit 30, the individual display unit 31 and so on. The control unit 50 is configured to obtain information from them and to transmit an operation command to them.

<<Operation/Effect>>

Next, an operation/effect of the embodiment as structured above will be explained.

According to this embodiment, there is provided the operation unit (sorting-category receiving unit) 40 that receives at least one sorting category recognized by the control unit 50, and the control unit 50 is configured to create a sorting pattern by deciding types of banknotes to be stacked in the respective stacking units 60*a* to 60*h*, based on the number of the stacking units 60*a* to 60*h* and the sorting category received by the operation unit 40. Thus, banknotes can be easily sorted according to a purposed desired by a user, without excessive burden on the user.

Namely, in the conventional banknote handling apparatus described in WO2008/096429, a user can freely decide a sorting condition for each sorting category, such as the denomination of the banknote, the version of the banknote, the orientation of the banknote, the fitness of the banknote and so on, to be staked in each stacking unit. However, in such the banknote handling apparatus, a degree of freedom of setting is high, while a setting operation is complicated. When banknotes are sorted based on a predetermined purpose, it is necessary for a user to have a full knowledge about the sorting condition for each sorting category set for each stacking unit. Thus, it is very difficult to create a sorting pattern to sort banknotes, just as a purpose desired by the user. In particular, in a case where plural times of sorting in different settings are required for a set of banknotes to be sorted, it is necessary to switch settings. It makes an operation complicated.

On the other hand, according to this embodiment, the control unit 50 is configured to create a sorting pattern by deciding types of banknotes to be stacked in the respective stacking units 60*a* to 60*h*, based on the number of stacking units 60*a* to 60*h* (in this embodiment "eight") and the sorting category received by the operation unit 40, and configured to perform a banknote sorting process in accordance with the sorting pattern. Thus, banknotes can be easily sorted according to a purposed desired by a user, without excessive burden on the user.

In addition, in this embodiment, since the control unit 50 is configured to create a plurality of sorting patterns, banknotes can be stacked in the respective stacking units 60*a* to 60*h* with the plurality of sorting patterns. More specifically, when the control unit 50 in this embodiment decides that plural times of sorting process are necessary and that two or more sorting patterns different from one another are needed to be created, in order to sort banknotes based on the sorting category received by the operation unit 40, the control unit 50 sorts the banknotes by using these sorting patterns and stacks the banknotes in the sorting units 60*a* to 60*h*.

Thus, according to this embodiment, even when it is necessary to perform plural times of the sorting process and it is necessary to create two or more sorting patterns different from one another, in order to sort banknotes according to a purpose desired by a user, the banknote can be suitably sorted and stacked in the stacking units 60*a* to 60*h*.

On the other hand, it is not always necessary to create two or more sorting patterns different from one another, even when the plural times of sorting processes are required. When the control unit 50 in this embodiment decides that it is necessary to use a duplicated sorting pattern for sorting banknotes based on the sorting category, the control unit 50 sorts the banknotes by using the duplicated sorting pattern and stacks the banknotes in the stacking units 60*a* to 60*h*.

Thus, according to this embodiment, even when it is necessary to use a duplicated sorting pattern in order to sort banknotes according to a purpose desired by a user, the banknotes can be suitably sorted and stacked in the stacking units 60*a* to 60*h*.

Further, when the control unit in this embodiment decides that it is necessary to use three or more times of sorting processes for sorting banknotes based on the sorting category, the control unit 50 can create different sorting patterns for each time, and sort the banknotes by using the sorting patterns to stack the banknotes in the stacking units 60*a* to 60*h*. Alternatively, the control unit 50 can use both two or more sorting patterns different from one another and a duplicated sorting pattern, and sort the banknotes to stack the banknotes in the stacking units 60*a* to 60*h*.

Thus, according to this embodiment, since different sorting patterns and the same sorting pattern can be used in a mixed manner if required, banknotes can be more suitably sorted and stacked in the stacking units 60*a* to 60*h*.

In this embodiment, the control unit 50 decides whether the plural times of sorting processes are required or not in order to sort banknotes based on the sorting category received by the operation unit 40, and when the control unit 50 decides that the plural times of sorting processes are required, the control unit 50 automatically decides, not only sorting patterns to be used, but also a using order of the sorting patterns. Thus, it is not necessary for a user to decide even an order of the sorting processes, and a burden on the user can be more reduced. The control unit 50 may automatically select an order along which the number of banknotes to be rejected decreases, based on a previous record stored in the memory unit 55. According to such an example, an efficiency of the banknote sorting process can be enhanced.

In addition, in this embodiment, after finishing the sorting process of n-th time, the control unit 50 is automatically set to sort banknotes based on a sorting pattern to be used in the sorting process of (n+1)-th time. Thus, it is not necessary for a user to set a sorting pattern, which enhances the convenience for the user.

In addition, in this embodiment, the control unit 50 is configured to output information related to an operation to be next required and related to a sorting process to be next performed, and the main display unit 30 is configured to display the information. Thus, a user can easily understood an operation to be performed by himself/herself and the sorting process to be next performed.

A plurality of sorting patterns created by the control unit 50 is stored in the memory unit 55. The control unit 50 is configured to suitably read out the sorting patterns stored in the memory unit 55, so as to sequentially perform the banknote sorting process.

In addition, it is possible that the memory unit 55 stores a sorting pattern created by the control unit 50 for a long period of time, and that, in the next or later banknote sorting process, the control unit 50 reads out the sorting pattern stored in the memory unit 55 so as to perform the banknote sorting process.

In an example in which the denomination of the banknote is included in the sorting category, a sorting pattern can be created based on a denomination of a banknote to be stacked in each of the stacking units 60*a* to 60*h*, and banknotes can be sorted based on the denomination of the banknote.

In addition, in an example in which the currency type is included in the sorting category, a sorting pattern can be created based on a type of currency to be stacked in each of the stacking units 60*a* to 60*h*, and banknotes can be sorted based on the currency type.

In addition, in an example in which the orientation of the banknote is included in the sorting category, a sorting pattern can be created based on an orientation of a banknote to be stacked in each of the stacking units 60*a* to 60*h*, and banknotes can be sorted based on the orientation of the banknote.

In addition, in an example in which the fitness of the banknote is included in the sorting category, a sorting pattern can be created based on a fitness of a banknote to be stacked in the each of the stacking units 60*a* to 60*h*, and banknotes can be sorted based on the fitness of the banknote.

In addition, in an example in which the version of the banknote is included in the sorting category, a sorting pattern can be created based on a version of a banknote to be stacked in each of the stacking units 60*a* to 60*h*, and banknotes can be sorted based on the version of the banknote.

EXAMPLES

Herebelow, the present invention is explained using concrete examples.

Example 1

In Example 1, there is explained an example in which not only a sorting pattern but also a using order of sorting patterns is automatically decided. In Example 1, after finishing the sorting process of n-th time, the control unit 50 is automatically set to sort banknotes based on a sorting pattern to be used in the sorting process of (n+1)-th time.

A user firstly inputs an instruction for starting the banknote sorting process through the operation unit 40.

The control unit 50, which has received the instruction for starting the sorting process, transmits an operation command to the main display unit 30, and causes the main display unit 30 to display "Select category for sorting.".

In accordance with the instruction, the user selects a desired sorting category for sorting, through the operation unit (sorting-category receiving unit) 40. Herebelow, the present invention is explained by taking an example in which the user desires that banknotes are sorted by denomination, fitness and version. The "product" of the number of elements in this case is 4×3×2=24, which is larger than the number of the stacking units 60*a* to 60*h* (eight). Thus, this example corresponds to a case in which the plural times of sorting processes are required.

Then, upon receipt of the operation command from the control unit 50, the main display unit 30 displays "Sorting based on denomination is performed. Set banknotes in inlet opening.".

In accordance with the instruction, the user places banknotes on the placing unit 11, and inputs an instruction for performing the sorting process through the operation unit 40.

When the instruction for performing the sorting process has been inputted from the operation unit 40, the banknote handling apparatus 100 starts the sorting process based on the denomination. As a sorting pattern at this time, for example, the denomination is under the "specified mode", a 10,000-yen banknote is stacked in the first stacking unit 60*a*, a 5,000-yen banknote is stacked in the second stacking unit 60*b*, a 2,000-yen banknote is stacked in the third stacking unit 60*c*, and a 1,000-yen banknote is stacked in the fourth stacking unit 60*d* (see FIG. 6(*a*)). At this time, the banknotes are stacked in such a manner that the orientation of the banknote, the fitness of the banknote and the version of the banknote are under the "mixed mode".

When the sorting process based on the denomination of the banknote has been finished, the user takes out the banknotes from the respective stacking units 60*a* to 60*d*. After the taking out of the banknotes has been finished, the control unit 50 decides it based on the information from the remaining sensors 25*a* to 25*d*. Then, the control unit 50 transmits an operation command to the main display unit 30 and causes the main display unit 30 to display "Sorting based on fitness and version is performed. Set 10,000-yen banknotes in inlet opening.".

In accordance with this instruction, the user places 10,000-yen banknotes on the placing unit 11, and inputs an instruction for performing the sorting process through the operation unit 40.

When the instruction for performing the sorting process has been inputted from the operation unit 40, the banknote handling apparatus 100 starts the sorting process based on the fitness and the version. As the sorting pattern at this time, for example, the version is under the "automatic mode", and the fitness is under the "specified mode". A banknote that is sorted as a version of a banknote firstly decided (first banknote) and as "ATM" is stacked in the first stacking unit 60*a*, a banknote sorted as "first banknote" version and as "TLR" is stacked in the second stacking unit 60*b*, a banknote sorted as "first banknote" version and as "UNFIT" is stacked in the third stacking unit 60*c*, a banknote that is sorted as a version different from the version of the banknote having been firstly decided ("second banknote") and as "ATM" is stacked in the fourth stacking unit 60*d*, a banknote sorted as "second banknote" version and as "TLR" is stacked in the fifth stacking unit 60*e*, and a banknote sorted as "second banknote" version and as "UNFIT" is stacked in the sixth stacking unit 60*f* (see FIG. 6(*b*)).

The aforementioned "ATM" means a banknote that can be used as a banknote to be dispensed from an ATM installed in a financial facility such as a bank, "TLR" means a banknote that cannot be used in an ATM but can be used as a banknote to be dispensed from a counter of a financial facility such as a bank, and "UNFIT" means a banknote that cannot be used as a banknote to be dispensed from an ATM and cannot be used as a banknote to be dispensed from a counter of a financial facility such as a bank.

In the manner as described above, when the sorting process of 10,000-yen banknotes based on the fitness and the version has been finished, the user takes out the 10,000-yen banknotes from the respective stacking units 60*a* to 60*h*.

Thereafter, the sorting process for the 5,000-yen banknotes, the 2,000-yen banknotes and 1,000-yen banknotes are respectively performed based on the fitness and the version.

In the above-described Example 1, the sorting patterns that are different from one another are used in the sorting process based on the denomination and the sorting process based on the fitness and the version. On the other hand, the duplicated sorting pattern is used in the sorting process based on the fitness and based on the version in each denomination.

Example 2

In Example 2, the aspect, in which a sorting pattern is decided, but an order of the sorting processes to be performed is selected by a user, is used and explained.

A user firstly inputs an instruction for starting a banknote sorting process through the operation unit 40.

The control unit 50, which has received the instruction for starting the sorting process, transmits an operation command to the main display unit 30 and causes the main display unit 30 to display "Select category for sorting.".

In accordance with the instruction, the user selects a desired sorting category for sorting, through the operation unit (sorting-category receiving unit) 40. Herebelow, the present invention is explained by taking an example in which the user desires that banknotes are sorted based on the denomination and the orientation. The "product" of the number of elements in this case is 4×4=16, which is larger than the number of the stacking units 60*a* to 60*h* (eight). Thus, this example corresponds to a case in which the plural times of sorting processes are required.

When the user has selected that banknotes are to be sorted based on the denomination and the orientation, the control unit 50 creates a sorting pattern for sorting banknotes based on the denomination and the orientation. To be specific, for example, read out are the sorting patterns such as: a sorting pattern (see FIG. 7(*a*)) in which the denomination and the orientation are under the "specified mode", a 10,000-yen banknote in the A orientation is stacked in the first stacking unit 60*a*, a 10,000-yen banknote in the B orientation is stacked in the second stacking unit 60*b*, a 10,000-yen banknote in the C orientation is stacked in the third stacking unit 60*c*, a 10,000-yen banknote in the D orientation is stacked in the fourth stacking unit 60*d*, a 1,000-yen banknote in the A orientation is stacked in the fifth stacking unit 60*e*, a 1,000-yen banknote in the B orientation is stacked in the sixth stacking unit 60*f*, a 1,000-yen banknote in the C orientation is staked in the seventh stacking unit 60*g*, and a 1,000-yen banknote in the D orientation is stacked in the eighth stacking unit 60*h*; and a sorting pattern (see FIG. 7(*b*)) in which the denomination is under the "automatic mode" and the orientation is under the "specified mode", a banknote of a denomination of a banknote firstly decided (first banknote) in the A orientation is stacked in the first stacking unit 60*a*, a banknote of a denomination of the "first banknote" in the B orientation is stacked in the second stacking unit 60*b*, a banknote of a denomination of the "first denomination" in the C orientation is stacked in the third stacking unit 60*c*, a banknote of a denomination of the "first denomination" in the D orientation is stacked in the fourth stacking unit 60*d*, a banknote of a denomination firstly decided as a denomination different from the denomination of the firstly decide banknote (denomination of the "second banknote") in the A orientation is stacked in the fifth stacking unit 60*e*, a banknote of a denomination of the "second banknote" in the B orientation is stacked in the sixth stacking unit 60*f*, a banknote of a denomination of the "second banknote" in the C orientation is stacked in the seventh stacking unit 60*g*, and a banknote of a denomination of the "second banknote" in the D orientation is stacked in the eighth stacking unit 60*h*.

The read out the sorting patterns are displayed on the main display unit 30, and the main display unit 30 displays "Select sorting pattern.".

Then, the user selects one sorting pattern out of the read out sorting patterns through the operation unit 40. In this example, it is supposed that the sorting pattern in which the denomination and the orientation are under the "specified mode" (see FIG. 7(*a*)) is selected out of the above-described sorting patterns.

Then, upon receipt of the operation command from the control unit 50, the main display unit 30 displays "Sorting based on denomination and orientation is performed. Set banknotes in inlet opening.".

In accordance with the instruction, the user places banknotes on the placing unit 11, and inputs an instruction for performing a sorting process through the operation unit 40.

When the instruction for performing the sorting process has been inputted from the operation unit 40, the banknote handling apparatus 100 starts the sorting process based on the denomination of the banknote and the orientation of the banknote. At this time, the banknotes are sorted in such a manner that the fitness and the version are under the "mixed mode".

After finishing the first sorting process based on the denomination and the orientation, the user takes out the banknotes from the respective stacking units 60*a* to 60*h*. In the sorting pattern in which the denomination and the orientation are under the "specified mode", a 2,000-yen banknote and a 5,000-yen banknote are transported to the reject unit. In this case, if the set of banknotes placed on the placing unit 11 includes neither 2,000-yen banknote nor 5,000-yen banknote, there is no banknote that is transported to the reject unit. Thus, the banknote sorting process based on the denomination and the orientation is finished only by this first sorting process based on the denomination and the orientation.

Meanwhile, when there is a banknote having been transported to the reject unit, the main display unit 30 displays "Sorting based on denomination and orientation is performed. Set banknote in reject unit in inlet opening.", upon receipt of an operation command from the control signal 50.

In accordance with the instruction, the user places the banknotes in the placing unit 11, and inputs an instruction for performing the sorting process through the operation unit 40.

When the instruction for performing the sorting process has been inputted from the operation unit 40, the banknote handling apparatus 100 starts the sorting process based on the denomination and the orientation. At this time, there is used a sorting pattern in which the denomination and the orientation are under the "specified mode", a 5,000-yen banknote in the A orientation is stacked in the first stacking unit 60*a*, a 5,000-yen banknote in the B orientation is stacked in the second stacking unit 60*b*, a 5,000-yen banknote in the C orientation is stacked in the third stacking unit 60*c*, a 5,000-yen banknote in the D orientation is stacked in the fourth stacking unit 60*d*, a 2,000-yen banknote in the A orientation is stacked in the fifth stacking unit 60*e*, a 2,000-yen banknote in the B orientation is stacked in the sixth stacking unit 60*f*, a 2,000-yen banknote in the C orientation is stacked in the seventh stacking unit 60*g*, and a 2,000-yen banknote in the D orientation is stacked in the eight stacking unit 60*h* (see FIG. 7(*c*)). In addition, the banknotes are sorted in such a manner that the fitness and the version are under the "mixed mode". In addition, the sorting pattern shown in FIG. 7(*b*) may be used in the second sorting process. Since the banknotes to be sorted in the second sorting process are only a 5,000-yen banknote and a 2,000-yen banknote. Thus, out of a 5,000-yen banknote and a 2,000-yen banknote, a banknote of a denomination that is recognized earlier is stacked in the first to fourth stacking units 60*a* to 60*d*, and a banknote of a denomination that is recognized later is stacked in the fifth to eighth stacking units 60*e* to 60*h*.

After finishing the sorting process based on the denomination and the orientation, the user takes out the banknotes from the respective stacking units 60*a* to 60*h*, and the sorting process based on the denomination and the orientation to the set of banknotes is finished.

The disclosure by the embodiment, the examples described above and the drawings is a mere example for explaining the inventions recited in the claims, and the inventions recited in the claims will not be limited by the disclosure of the embodiment, the examples described above and the drawings.

The invention claimed is:

1. A banknote handling apparatus configured to perform a sorting process of banknotes, the banknote handling apparatus comprising:

a taking-in unit configured to take in a banknote one by one;

a transport unit configured to transport the banknote having been taken in from the taking-in unit;

a recognition unit configured to recognize the banknote transported by the transport unit;

a plurality of stacking units configured to stack the banknote recognized by the recognition unit;

a sorting-category receiving unit configured to receive one or more sorting categories selected from a currency type, a denomination of the banknote, an orientation of the banknote, a fitness of the banknote and a version of the banknote; and a control unit configured to create one or more sorting patterns to stack the banknote recognized by the recognition unit in the plurality of stacking units, the sorting patterns setting the elements of the received sorting categories for the stacking units based on the result of a comparison of the number of stacking units with a mathematical product of the number of elements of the one or more received sorting categories.

2. The banknote handling apparatus according to claim 1, wherein the control unit is configured to decide whether plural times of the sorting processes are required or not, in order to sort banknotes based on the one or more sorting categories received by the sorting-category receiving unit, and when the control unit decides that the plural times of the sorting processes are required, the control unit creates at least two sorting patterns different from one another.

3. The banknote handling apparatus according to claim 1, wherein the control unit is configured to decide whether plural times of the sorting processes are required or not, in order to sort banknotes based on the one or more sorting categories received by the sorting-category receiving unit, and when the control unit decides that the plural times of the sorting processes are required, the control unit sorts the banknotes by using a duplicated sorting pattern at least once and stacks the banknotes in the stacking units.

4. The banknote handling apparatus according to claim 1, wherein the control unit is configured to decide whether three or more times of the sorting processes are required or not, in order to sort banknotes based on the one or more sorting categories received by the sorting-category receiving unit, and when the control unit decides that three or more times of the sorting processes are required, the control unit creates at least two sorting patterns different from one another, sorts the banknotes by using each sorting pattern and stacks the banknotes in the stacking units, and the control unit sorts the banknotes by using a duplicated sorting pattern at least once and stacks the banknotes in the stacking units.

5. The banknote handling apparatus according to claim 1, wherein the control unit is configured to decide whether plural times of the sorting processes are required or not, in order to sort banknotes based on the one or more sorting categories received by the sorting-category receiving unit, and when the control unit decides that the plural times of the sorting processes are required, the control unit automatically decides sorting patterns to be used and a using order of the sorting patterns.

6. The banknote handling apparatus according to claim 1, wherein after finishing the sorting process of n-th time, the control unit is automatically set to sort banknotes based on a sorting pattern to be used in the sorting process of (n+1)-th time.

7. The banknote handling apparatus according to claim 1, wherein the control unit is configured to output information related to an operation to be next required or related to the sorting process to be next performed.

8. The banknote handling apparatus according to claim 1, wherein the sorting pattern is created by selecting a predetermined sorting mode out of a plurality of sorting modes, for each stacking unit and for each sorting category.

* * * * *